United States Patent [19]

Seaman et al.

[11] Patent Number: 4,788,843

[45] Date of Patent: Dec. 6, 1988

[54] METHOD AND APPARATUS FOR HYDRAULICALLY FORMING A TUBULAR BODY

[75] Inventors: Roy C. Seaman; Ronald M. McCaul, both of Tucson, Ariz.

[73] Assignee: R. Seaman Company, Tucson, Ariz.

[21] Appl. No.: 85,380

[22] Filed: Aug. 14, 1987

[51] Int. Cl.[4] ..... B21D 26/02; B21D 39/08

[52] U.S. Cl. ..... 72/58; 72/62

[58] Field of Search ..... 29/421 R; 72/58, 59, 72/61, 62

[56] References Cited

U.S. PATENT DOCUMENTS 1,210,629 1/1917 Foster ..... 72/61

3,625,040 12/1971 DeGain ..... 72/62 X

FOREIGN PATENT DOCUMENTS 276247 8/1927 United Kingdom ..... 72/62

*Primary Examiner*—E. Michael Combs

*Attorney, Agent, or Firm*—Dressler, Goldsmith, Shore, Sutker & Milnamow, Ltd.

[57] ABSTRACT

A method and apparatus for hydraulically forming metallic tubular bodies are disclosed. A forming die is provided, with the interior of the die configured to receive the tubular body to be shaped. The tubular body is filled with liquid, preferably water, with the interior of the tubular body then sealed. A forming plunger is thereafter inserted into the tubular body whereby localized hydraulic pressurization of the liquid within the body is effected. Outward deformation of the body toward the interior of the forming die thus results, with the formation of tapers, steps, projections, or other desired features readily achieved. The present invention is particularly suited for forming the tubular components of musical instruments.

9 Claims, 2 Drawing Sheets

METHOD AND APPARATUS FOR HYDRAULICALLY FORMING A TUBULAR BODY

TECHNICAL FIELD

The present invention relates generally to metal-working techniques, and more particularly to a method and apparatus for hydraulically forming and shaping a metallic tubular body by localized, internal pressurization thereof, with the present invention particularly suited for forming tubular components of musical instruments.

BACKGROUND OF THE INVENTION

A wide variety of techniques are known for forming and otherwise working metallic tubular elements. Such techniques include turning, drawing, extrusion, boring, and the like. In all of these techniques, mechanical force is applied to the workpiece with the forming or cutting tools, thereby effecting the desired shaping or other work operations.

Despite the wide variety of well-known metal working techniques, the desired shaping and formation of some types of tubular elements remains labor-intensive and time-consuming. By way of example, the formation of tubular bodies to provide the components of various types of musical instruments has heretofore been quite labor-intensive. A typical metallic tubular body such as for a flute, piccolo, saxophone, or the like, is ordinarily generally elongated, and can include both cylindrical and/or tapering sections. Additionally, many such components include a plurality of "tone" holes with which movable keys are associated for achieving the desired tonal effect.

In the past, it has been necessary to first shape such a tubular body to define the desired cylindrical and/or tapered configuration, with any steps or like changes in cross-section as required. Tone holes must then be formed in the tubular body, with small cylindrical "risers" or "chimneys" then individually soldered into position at each tone hole to provide a flat, circular surface for receiving the respective key.

In an effort to facilitate efficient and economical manufacture of musical instruments, the present tube-forming technique was developed. While the method and apparatus of the present invention are particularly suited for forming the tubular bodies used in musical instruments, it will be recognized that the economy and versatility provided by the metal-forming techniques of the present invention permit the invention to be used for a wide variety of applications.

SUMMARY OF THE INVENTION

The present invention concerns a method and apparatus for hydraulically forming and shaping a metallic tubular body by urging the body outwardly toward and against the interior of a forming die within which it is positioned. Significantly, despite the relatively high hydraulic forming pressures which are achieved by the present method, the invention can be readily practiced without the need for unduly complex or expensive equipment. This is achieved by locally effecting the desired hydraulic pressurization essentially only within the tubular body to be shaped and formed. Thus, the present technique desirably obviates the need for any high pressure pumps, piping, and the like which have been otherwise required for previous hydraulic metal-forming.

In accordance with the method of the present invention, a forming die is provided which defines an interior configured to receive the tubular body which is to be shaped and formed. The forming die is openable by providing the die in two halves, with the forming dies of the illustrated embodiments having interiors which define a pair of open ends so that the open ends of the tubular body to be formed can be positioned in respective association with the open ends of the interior of the die.

The tubular body to be formed is then positioned within the interior of the forming die, and the die closed. Depending upon the shape to which the tubular body is to be finally formed, the tubular body may be previously shaped, such as to define a taper, for example. In order to facilitate securement of the tubular body in position within the die, and subsequent sealing, it is preferred that the open ends of the body be outwardly flared prior to disposition in the forming die.

To effect hydraulic forming, the tubular body is next filled with liquid, which in accordance with the preferred practice, is desirably water. In the illustrated embodiment, a liquid inlet and a liquid outlet are desirably incorporated into a pair of end seal members which act to seal the interior of the tubular body attendance to its hydraulic deformation. Thus, in the illustrated embodiment wherein the tubular body has a pair of open ends, the tubular body is filled with liquid by flow of liquid from the inlet to the outlet through the interior of the body.

After the tubular body is filled with liquid, hydraulic deformation is effected. The hydraulic deformation is in the nature of blow-molding, and is achieved by the provision of first and second forming plungers, at least one of which is inserted into the tubular body to locally pressurize the liquid therein. While the quantity of liquid actually displaced during hydraulic deformation is relatively small (typically on the order of several ounces or less), many tons of hydraulic forming pressure are nevertheless exerted within the interior of the tubular body, thereby deforming the body outwardly toward the interior of the forming die. Depending upon the degree of deformation to be achieved, the steps of filling the tubular body with liquid, and thereafter inserting one or both of the forming plungers can be repeated as necessary to fully urge and deform the tubular body against the interior of the forming die.

In one illustrated embodiment of the present apparatus, one of the two forming plungers is power-driven for effecting hydraulic pressurization, while the other of the plungers can be fixed and locked in position after the interior of the tubular body is sealed. In an alternate embodiment, both of the forming plungers are power-driven, whereby the plungers are simultaneously inserted into the tubular body for hydraulic deformation.

Other features and advantages of the present invention will become readily apparent from the following detailed description, the accompanying drawings, and the appended claims.

DETAILED DESCRIPTION

Figure 1:
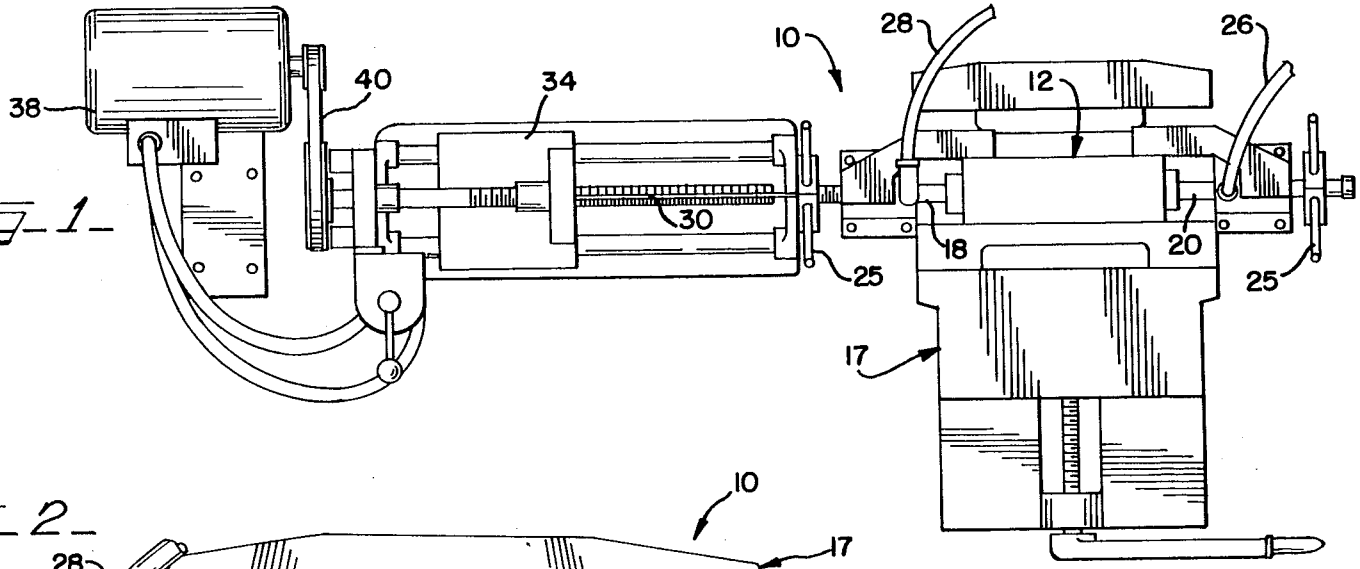
FIG. 1 is a top plan view of an apparatus for hydraulically forming a metallic tubular body embodying the principles of the present invention.

While the present invention is susceptible of embodiment in various forms, there is shown in the drawings and will hereinafter be described presently preferred embodiments, with the understanding that the present disclosure is to be considered as an exemplification of the invention, and is not intended to limit the invention to the specific embodiments illustrated.

Figure 3:
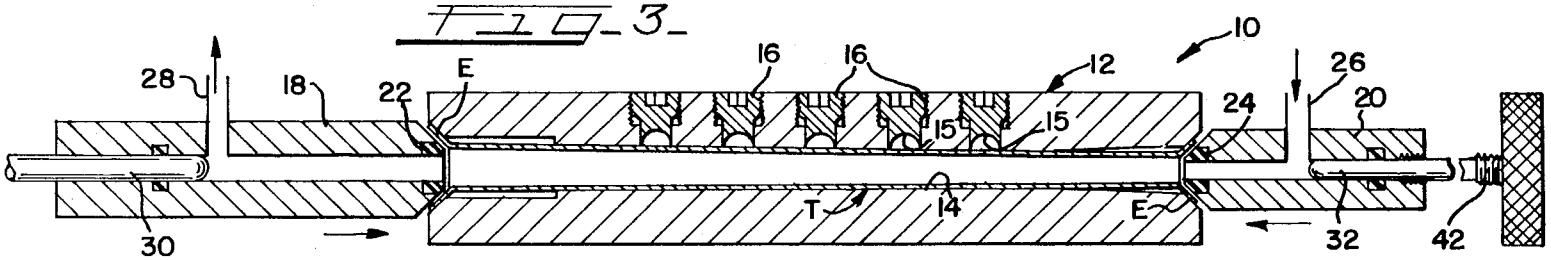
FIGS. 3 and 4 are successive diagrammatic views illustrating the hydraulic tube-forming technique of the present invention.
Figure 4:
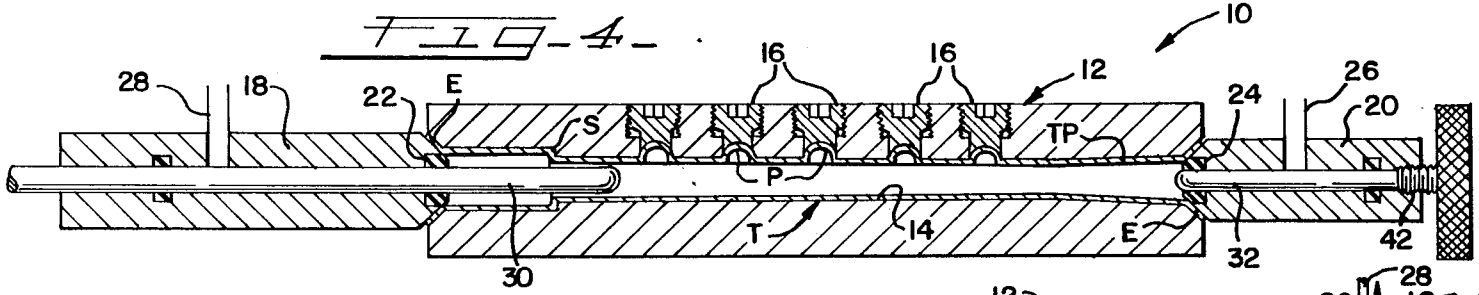
Figure 5:
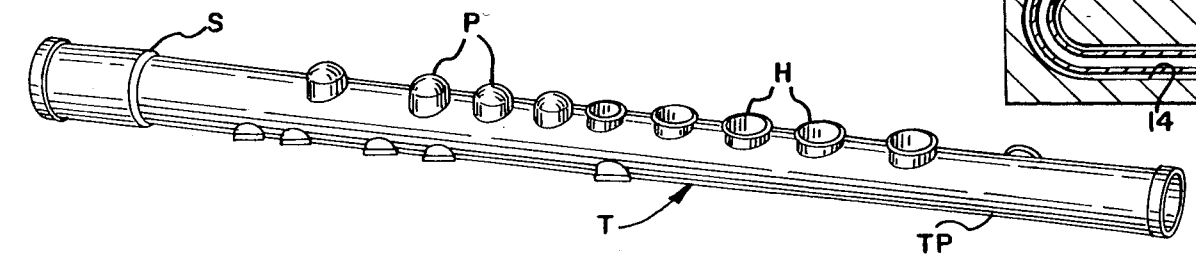
FIG. 5 is a perspective view of a tubular body comprising a musical instrument component formed in accordance with the method of the present invention.

Referring first to FIGS. 1-5, therein is illustrated a hydraulic tube-forming apparatus 10 embodying the principles of the present invention. By way of illustration, the present invention will be described in connection with the formation and shaping of a tubular body T such as for a musical instrument. Referring particularly to FIG. 5, the tubular body T is shown in its substantially finished form as a piccolo body, and includes a stepped section S, a reverse taper portion TP, and a plurality of outwardly formed projections P which are subsequently drilled and shaped to provide finished tone holes H.

The present invention can be practiced for shaping any metallic tubular body which exhibits sufficient ductility to undergo the desired degree of deformation without fracture. Suitable metals include those from which musical instruments are typically fabricated, such as nickel, silver, brass, copper, and alloys thereof.

Figure 2:
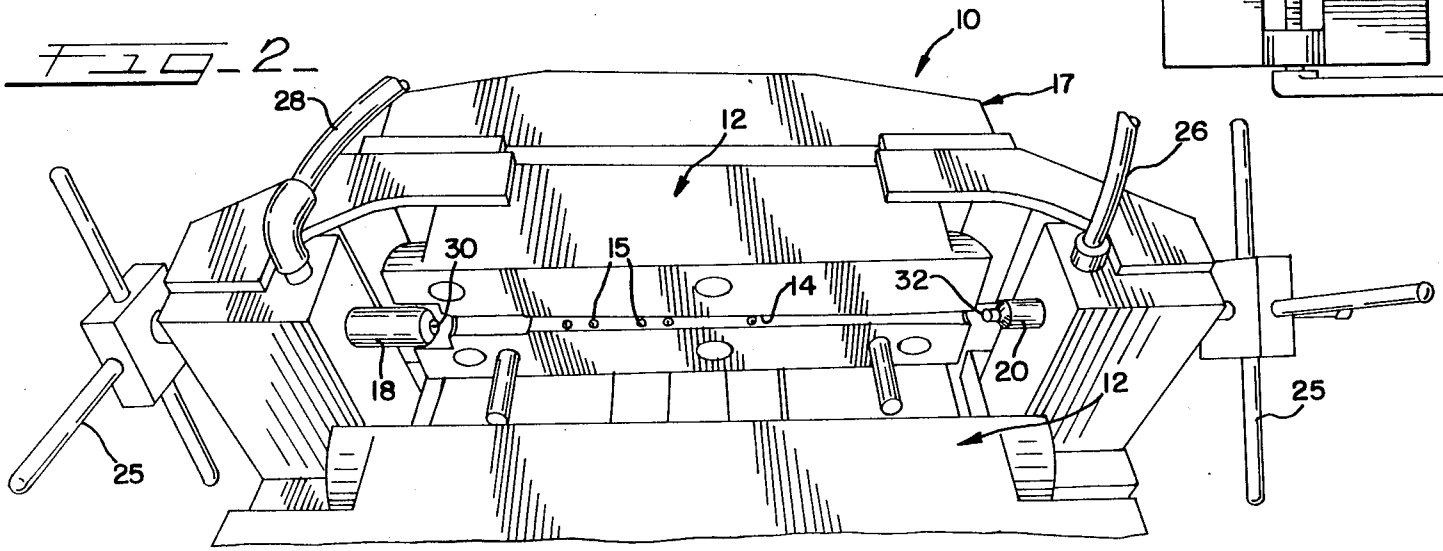
FIG. 2 is a fragmentary, perspective view of the apparatus shown in FIG. 1 illustrating a forming die of the apparatus in an opened condition for positioning of a tubular body therein.

With further reference to FIGS. 1 and 2, the forming apparatus 10 includes an openable forming die 12, which in the preferred form comprises a pair of die halves which can be closed so that they together define the interior 14 of the die. The interior 14 of the die is configured to receive the tubular member T to be hydraulically formed, with the interior of the die shaped to define the desired final configuration of the exterior of the hydraulically-formed tubular body. To this end, the die 12 defines at its interior a plurality of openings or reliefs 15 (see FIG. 3) such as for forming projections P. As shown in FIGS. 3 and 4, reliefs 15 are preferably defined by threaded inserts 16 of the forming die 12. The threads of the inserts 16 desirably permit venting of air from the interior of the die and the pocket-like reliefs 15, and facilitate convenient adjustment of the inserts so that "blow-out" (i.e., fracture) of the projections P being formed can be prevented by limiting the outward deformation of the projections.

As best shown in FIG. 1, a die clamping mechanism 17 securely holds the forming die 12 in a closed condition after positioning of tubular body T in the interior of the die. As best shown in FIG. 3, the open ends of the tubular member T are preferably outwardly flared, as shown at E, to facilitate securement of the tubular body within the forming die, and to facilitate sealing the interior of the tubular body.

A pair of end seal members 18 and 20 are respectively positionable in association with the open ends of the forming die 12 and the tubular body T. Notably, these end seal members can be desirably configured to perform a plurality of functions. First, each end seal member 18 and 20 is fitted with a respective annular, elastomeric seal 22, 24, with the seals 22 and 24 being respectively positionable in sealing engagement with the open, outwardly flared ends of the tubular body T. Urging of the seals 22 and 24 into sealing engagement with the tubular body is preferably effected by moving the seal members 18 and 20 toward the forming die 12, such as through the use of threaded lock wheels 25, as shown in FIGS. 1 and 2. Annular seals 22 and 24 are preferably configured such that each seal presents a surface which is exposed to the liquid within tubular body T attendant to pressurization of the liquid, with the liquid thus exerting pressure against the seals for enhancing their sealing effect.

The end seal members 18 and 20 further desirably function to provide a convenient and efficient means for filling the tubular body T with the liquid to be pressurized for hydraulic tube-forming. Each of the end seal members 18 and 20 defines an interior bore which is in respective fluid communication with one of a liquid inlet 26 and a liquid outlet 28 for directing a flow of liquid through annular seals 22, 24 and tubular body T to effect filling thereof. As noted, the present invention is preferably practiced through the use of water as the working liquid, with an anti-corrosion agent preferably added to abate any corrosion of the forming die and other components. Since filling of the tubular body T with liquid is effected at substantially non-elevated pressures, a simple pump and reservoir system (not shown) can be used for effecting filling. To promote convenient operation, the liquid outlet 28 may be configured to include a section of transparent tubing, thus facilitating inspection of the liquid outlet flow to be sure that all air bubbles have passed out of the interior of the tubular body. As will be appreciated, the presence of any air or other compressible fluid can adversely affect hydraulic deformation of the tubular body.

In accordance with the present invention, hydraulic deformation of tubular body T is effected by inserting plunger means into the tubular body for locally pressurizing the liquid therein. To this end, the present apparatus includes first and second forming plungers 30 and 32 respectively associated with the opposite open ends of the forming die 12 and the tubular body T. As is evident from FIGS. 3 and 4, the end seal members 18 and 20 serve the further function of receiving and guiding the plungers 30 and 32. In this embodiment, the first plunger 30 is power-driven, and to this end, is connected to a drive carriage 34 (FIG. 1) which is slidably mounted for reciprocable movement on an associated support structure. A power lead screw 36 is threadably connected with the drive carriage 34, whereby driven rotation of the lead screw by drive motor 38 via drive belt 40 drives the first plunger 30 through its respective end seal member 18, through annular seal 22, and into tubular body T for effecting hydraulic deformation thereof.

While the first plunger 30 is power-driven, the second forming plunger 32 of this embodiment is arranged to be locked in position, with hydraulic deformation thus effected by the first plunger 30. To this end, the second plunger 32 is movable within the internal bore of its respective end seal member 20 so that it extends into its respective annular seal 24, thus providing the desired liquid seal at this open end of the tubular body. Attendant to this action, the second plunger 32 can be locked in position such as by the provision of screw threads 42 which permit the plunger 32 to be locked relative to its respective end seal member 20.

From the foregoing description, practice of the present invention will be readily apparent. With the forming die 12 opened generally shown as in FIG. 2, the tubular body to be hydraulically formed is placed in position within the interior 14 of the forming die. Not only are the open ends of the tubular body preferably outwardly flared, thus facilitating disposition of annular seals 22 and 24 therein for effecting liquid sealing, the tubular body can also be otherwise shaped prior to hydraulic forming, depending upon the final configuration. For example, and as is illustrated in FIG. 3, formation of a piccolo body, which has oppositely tapered portions, is facilitated by first forming the tubular body to an overall tapered configuration before positioning in the forming die.

After the halves of the forming die 12 are closed and tightly secured in position with clamping mechanism 17, end seal members 18 and 20 are moved toward the forming die so that annular seals 22 and 24 are positioned generally within the flared ends E of the tubular body in sealing engagement therewith.

With forming plungers 30 and 32 generally in the positions diagrammatically illustrated in FIG. 3, the tubular body T is filled with liquid, preferably by flow from inlet 26, through end seal member 20 and annular seal 24, the interior of tubular body T, seal 22 and seal member 18, and out of outlet 28.

After the tubular body is filled, liquid flow is stopped and second forming plunger 32 is fixed in position with screw threads 42. First plunger 30 is now operated for effecting hydraulic deformation of the tubular body. As the plunger 30 is moved within its respective end seal member 18, excess liquid flows around the clearance between the plunger 30 and the interior of the seal member 18. As the plunger 30 moves into the annular seal 22, pressurization of liquid within the tubular body T is quickly effected, with the liquid exerting pressure against the annular seals 22 and 24 for enhancing the desired sealing.

Continued power-driven movement of plunger 30 results in very substantial hydraulic pressure (believed to be on the order of twenty tons, or more) being created within the tubular body for effecting its hydraulic deformation. As will be appreciated, this forming pressure urges and deforms the tubular body outwardly toward the interior of the forming die 12. Depending upon the degree of deformation to be effected, and the thickness and composition of the tubular body, it can sometimes be necessary to repeat the steps of filling the body with liquid and inserting the forming plunger therein. When, as in the illustrated embodiment, a piccolo body is being formed, projections P for the tone holes are formed at reliefs 15, with the step S and reverse taper TP also being hydraulically formed.

After hydraulic formation, the tubular body T is removed from the forming die, with any susequent finishing which may be required then performed. Notably, the present hydraulic formation technique acts to mildly coin the outer surfaces of the tubular body as they are urged against the interior of the forming die. This coining effect desirably smooths the exterior surfaces, and acts to eliminate any so-called "orange peel" surface roughness which can otherwise result attendant to deformation of a metal's grain structure. When the tubular body is to be finished for use in a musical instrument, the projections P can be suitably drilled and outwardly swaged and shaped, thus providing finished tone holes H with desired efficiency and economy.

The versatility of the present tube-forming technique is further illustrated by reference to FIG. 6, wherein an alternate embodiment of the present invention is diagrammatically illustrated. In this embodiment, a forming die 12 defines an interior 14 which has a pair of open ends and is generally U-shaped. A U-shaped tubular body T is positionable within the forming die for hydraulic deformation, such as for smoothing the exterior of the tubular body, and otherwise conforming it to the configuration of the interior of the forming die. An apparatus of this nature has been used for forming a pair of saxophone mouthpipes from a single U-shaped tubular member.

The outwardly flared ends of the tubular body T are configured to respectively receive annular seals 22 and 24, which are respectively mounted on end seal members 18 and 20. Liquid inlet and outlet 26 and 28 are preferably provided for effecting filling of the tubular body T.

Figure 6:
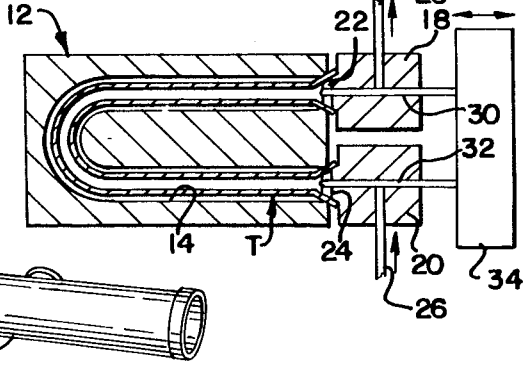
FIG. 6 is a diagrammatic view illustrating an alternate embodiment of the apparatus of the present invention.

While the previously-described embodiment was arranged such that only one of the forming plungers 30 and 32 was configured for power-driven insertion into the tubular body, the embodiment of FIGS. 6 is configured such that both of the forming plungers 30 and 32 are secured to a power-driven movable carriage 34 for simultaneous insertion of the forming plungers into the open ends of the tubular body.

One particularly desirable feature of this embodiment concerns the positioning of the forming plungers 30 and 32 for respective cooperation with the liquid inlet and outlet 26 and 28. In accordance with the illustrated arrangement, the forming plungers function in the nature of valves for automatically controlling liquid flow as the plungers are stroked and inserted into the ends of the tubular body T.

As the plungers 30, 32 are moved toward the ends of the tubular body T, they respectively close the liquid inlet and outlet 26, 28, with continued movement through the annular seals 22, 24 initiating hydraulic deformation of the tubular body. After the plungers have been fully inserted, they are withdrawn by the carriage 34, whereupon the inlet and outlet 26 and 28 are again opened so that tubular body T is again filled with liquid. The above sequence can then be repeated, thus very greatly facilitating formation of tubular components which require repeated deformation to achieve the finally desired exterior configuration. In a sense, a "pumping" action is effected to outwardly deform tubular body T.

As will be appreciated from the foregoing description, the present forming technique is not only particularly suited for manufacture of musical instruments, but is also readily adaptable for other tube-forming operations where conformance of a tubular body to the interior of a forming die is desired. As noted, the present invention desirably avoids the need for any high-pressure pumps or the like in view of the highly localized nature of the hydraulic forming pressures which are created. Additionally, it will be appreciated that the desired hydraulic deformation in accordance with the present invention is readily achieved with relatively small displacements of liquid; accordingly, any leaks which may occur ordinarily result in the loss of very little of the working liquid, thus contributing to the ease with which the present invention is practiced.

While the present invention has been disclosed in embodiments wherein the tubular body to be shaped defines a pair of open ends, it will be appreciated that the inveniton is equally suited for formation of tubular bodies having but a single open end. While hydraulic formation of generally elongated tubular bodies has been thus described, it will further be appreciated that cup-like tubular bodies can also be suitably shaped in accordance with the present invention.

From the foregoing, it will be observed that numerous modifications and variations can be effected without departing from the true spirit and scope of the novel concept of the present invention. It is to be understood that no limitation with respect to the specific embodiments disclosed herein is intended or should be inferred. The disclosure is intended to cover by the appended claims all such modifications as fall within the scope of the claims.

What is claimed is:

1. A method for hydraulically forming a metallic tubular body, comprising the steps of:

providing a forming die defining an interior configured to receive said tubular body therein;

positioning said tubular body within the interior of said forming die;

filling said tubular body with a liquid by providing end seal means having a liquid inlet, and positioning said end seal means in operative association with at least one open end of said tubular body so that said liquid flows through said liquid inlet of said end seal means for filling said tubular body; and inserting plunger means through said end seal means and into said open end of said tubular body so that said plunger means closes said liquid inlet, and thereafter pressurizes said liquid within said tubular body to thereby deform said tubular body outwardly toward the interior of said forming die, including sealing the interior of said tubular body with annular seal means on said end seal means, said annular seal means receiving said plunger means therethrough as said plunger means pressurizes the liquid in said tubular body, said pressurized liquid acting against said seal means for effecting sealing engagement with said plunger means.

2. A method of hydraulically forming a tubular body in accordance with claim 1, wherein said tubular body defines a pair of open ends, and said plunger means comprises first and second plungers respectively positionable in association with said open ends of said tubular body, said end seal means comprising a pair of end seal members, and said annular seal means comprising a pair of annular seals respectively provided on said end seal members and each receiving a respective one of said plungers therethrough, said inserting step comprising inserting at least one of said plungers into said tubular body to pressurize the liquid therein.

3. A method of hydraulically forming a tubular body in accordance with claim 2, wherein said inserting step comprises simultaneously inserting both of said first and second plungers into said tubular body.

4. A method of hydraulically forming a tubular body in accordance with claim 1, including:

providing liquid outlet means in respective association with another open end of said tubular body so that liquid flows from said inlet to said outlet means through said tubular body for effecting said filling step.

5. A method of hydraulically forming a tubular body in accordance with claim 1, including outwardly flaring the open end of said tubular body to accommodate positioning of said end seal means in sealing engagement with the open end of said tubular body.

6. A method of hydraulically forming a tubular body in accordance with claim 1, including repeating said filling and inserting steps to outwardly deform said tubular body toward and against the interior of said forming die.

7. An apparatus for hydraulically forming a metallic tubular body having a pair of open ends, comprising:

a forming die defining an interior configured to receive said tubular body therein:

means for sealing the interior of said tubular body after positioning of said tubular body in the interior of said forming die and filling of the tubular body with a liquid, including a pair of end seal members respectively engageable in sealing relationship with the open ends of said tubular member, one of said end seal members including liquid inlet means through which liquid flows for filling said tubular body, and annular seal means on said one end seal member; and plunger means insertable through said one end seal member and the annular seal means thereon, and into said tubular body so that said plunger means closes said liquid inlet means and thereafter pressurizes the liquid in said tubular body to thereby deform said tubular body outwardly toward the interior of said forming die, said pressurized liquid acting against said annular seal means for effecting sealing engagement thereof with said plunger means.

8. An apparatus for hydraulically forming a tubular body in accordance with claim 7, wherein said plunger means comprises first and second plungers respectively associated with the open ends of said tubular body, at least one of said plungers being insertable into said tubular body for pressurizing the liquid therein.

9. An apparatus for hydraulically forming a tubular body in accordance with claim 8, including means for simultaneously inserting said first and second plungers into said tubular body for pressurizing the liquid therein.

* * * * *